US009504304B2

(12) United States Patent
Katz

(10) Patent No.: US 9,504,304 B2
(45) Date of Patent: Nov. 29, 2016

(54) APPLICATOR FOR A FLOWABLE APPLICATION MEDIUM

(75) Inventor: Otto Katz, Schwabach (DE)

(73) Assignees: Ratioplast GmbH, Schwabach (DE); M. Heyer GmbH, Markt Erlbach-Eschenbach (DE); Johannes Katz, Schwabach (DE)

( * ) Notice: Subject to any disclaimer, the term of this patent is extended or adjusted under 35 U.S.C. 154(b) by 628 days.

(21) Appl. No.: 13/876,029

(22) PCT Filed: Sep. 16, 2011

(86) PCT No.: PCT/DE2011/001740
§ 371 (c)(1),
(2), (4) Date: Aug. 19, 2013

(87) PCT Pub. No.: WO2012/048678
PCT Pub. Date: Apr. 19, 2012

(65) Prior Publication Data

US 2013/0336703 A1 Dec. 19, 2013

(30) Foreign Application Priority Data

Oct. 6, 2010 (DE) ..... 10 2010 047 649
Oct. 6, 2010 (DE) ..... 10 2010 047 655

(51) Int. Cl.
*A45D 40/26* (2006.01)
*A45D 29/00* (2006.01)
*A45D 34/04* (2006.01)
*A45D 40/20* (2006.01)

(52) U.S. Cl.
CPC ..... *A45D 40/26* (2013.01); *A45D 29/00* (2013.01); *A45D 34/04* (2013.01); *A45D 40/20* (2013.01)

(58) Field of Classification Search
CPC combination set(s) only.
See application file for complete search history.

(56) References Cited

U.S. PATENT DOCUMENTS 4,773,785 A * 9/1988 Katz ..... A46B 11/0013 401/101
5,131,774 A * 7/1992 Katz ..... G01F 11/025 401/101
8,231,295 B2 * 7/2012 Armstrong ..... A45D 34/042 401/101
8,292,529 B2 * 10/2012 Francavilla ..... A45D 34/043 401/101

* cited by examiner

*Primary Examiner* — David Walczak
(74) *Attorney, Agent, or Firm* — Berliner & Associates

(57) ABSTRACT

An applicator (10) for a flowable application medium, in particular nail polish. The applicator comprises a reservoir (12) accommodating the application medium, said reservoir having, at its front end, a tip portion (14) with centrally arranged passage hole (16) for an application element (18) and, at its rear end, an actuating device for a piston rod (20), with the application element (18) being arranged at the front end of said piston rod and said rod serving to move the application element (18) out of the tip portion (14) and into an application medium discharge position, retain the application element (18) temporarily in the discharge position and, with the help of a spring element (48), retract the application element (18) into the tip portion (14). A closure cap (38) serves to close and seal off the tip portion (14). In the central section piston rod (20) is provided with flange (26). A sealing element (30) enables the piston rod (20) to be sealed off along its circumference.

30 Claims, 11 Drawing Sheets

APPLICATOR FOR A FLOWABLE APPLICATION MEDIUM

Figure 1:
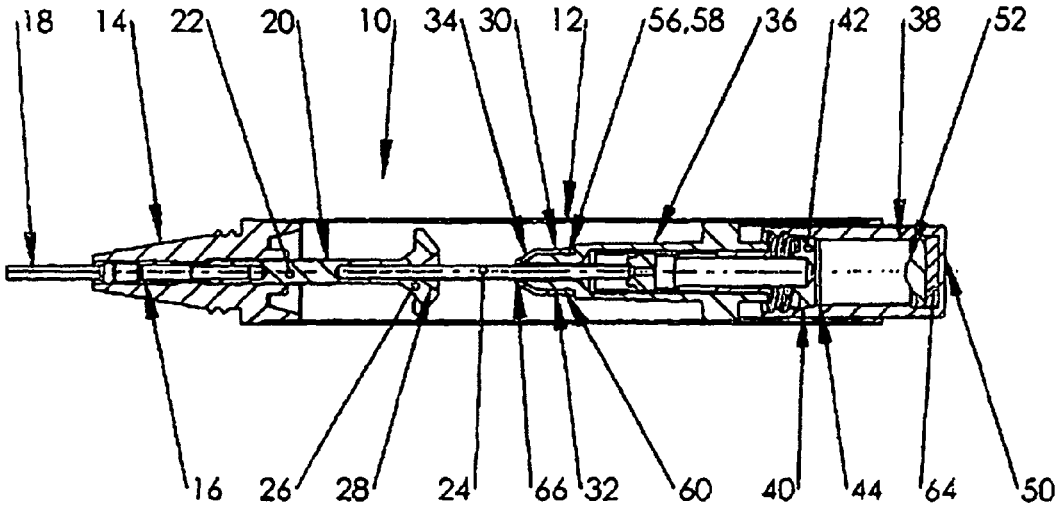

The invention relates to an applicator for a flowable application medium, in particular nail polish, comprising a reservoir accommodating the application medium, said reservoir having, at its front end, a tip portion with centrally arranged passage hole for an application element and, at its rear end, an actuating device for a piston rod, with the application element being arranged at the front end of said piston rod and said rod serving to move the application element out of the tip portion and into an application medium discharge position, retain the application element temporarily in the discharge position and, with the help of a spring element, retract the application element into the tip portion, and a cap for tightly sealing off the tip portion.

Such an applicator is known from publication DE 198 47 126 A1, for example. This prior-art applicator has a brush as application element. In this applicator a brush holder in its initial position is pressed via a disk against a tapered ring by means of a compression spring. Via a stop element of the disk the forward travel of the brush can be limited at a front end and the inlet bore of the tip portion of the applicator pen sealed against the reservoir. The applicator pen has an outer sleeve in which longitudinal slots and radial slots are arranged. Between the brush holder and a pusher-type actuating element a rod is loosely arranged.

DE 198 02 770 A1 discloses an applicator pen for a fluid application medium. This applicator pen is provided with an applicator element in the form of a brush. The fluid application medium is fed from a pump space to the applicator element through a duct. An enclosure serves to store the fluid application medium. Inside the storage space a follower piston and a displacement piston are arranged to displace the fluid application medium, said piston being moved transversely to the longitudinal axis of the applicator pen by a toggle lever. The longitudinally movable piston is molded onto a rod with coaxial duct, the total stroke of said piston being limited on the one hand through contact with a level surface of a closed suction valve and on the other hand through contact of a bushing with a chamfered portion of the toggle lever. The bushing longitudinally secured on the rod is in contact with an edge of the toggle lever on the one hand and otherwise contacts a compression spring. The compression spring abuts on a fixed disk.

DE 88 07 796 U1 describes an applicator pen for a fluid medium fed in dosed volume via an actuating element from a storage space to an application element which together with actuating element and dosing piston is movable in the longitudinal direction of the applicator pen and can be lowered in a bore. Between the bore accommodating the application element and the storage space of a dosing compartment seals are arranged, wherein the longitudinal distance between the sealing lips of the seals is greater than the distance between a control edge of a primary piston and a control edge of a secondary piston.

From DE 38 08 576 C1 an application device is known for fluids taken from a bottle by means of a brush. This prior-art application device is provided with a buffer compartment feeding the brush in a defined manner if it is taken out of the bottle. The brush in this case is connected to an actuating element by means of a rod and can be longitudinally moved within a tube. A displacement element guided on the rod is clamped in between a first and a second compression spring which on one end is supported by an actuating knob and on the other end by an abutment. An annular space can be isolated by means of a hub on one side and by the rod on the other. The stiffness of the second compression spring is preferably lower than that of the first compression spring. The displacement element is preferably designed in the form of a membrane provided with a hub capable of axial oscillation around a clamped sealing bead.

From DE 603 13 285 T2 an applicator for fluid cosmetic products is known which is provided with a piston rod carrying a piston longitudinally adjustable by turning a basis relative to an application nozzle equipped with a valve. The piston is provided with a ring flange attached to the piston rod. A cylindrical flange connects inside to said ring flange, said cylindrical flange has a circumferential lip at its inner end. The circumferential lip is in sliding seal contact with the inner wall of the application nozzle.

With this prior-art applicator the application of the fluid cosmetic product is not effected by actuating the rear actuating device, neither is the application element retracted by means of a spring element.

In U.S. Pat. No. 6,371,129 B1 an applicator is disclosed designed in the form of a mascara dispenser. This prior-art mascara dispenser has a piston rod to which front end a mascara brush is attached. The piston rod is arranged in an enclosure containing a flowable application medium and can be adjusted in the enclosure to and fro manually via a slider element to adjust, i.e. move the mascara brush out of or into the enclosure. At the front end of the enclosure a closure element is arranged which can be manually or automatically adjusted via a suitable connection by the slider element and in this way changed over from closed to open position and vice versa. Inside the mascara dispenser sealing elements are arranged to prevent volatile constituents contained in the application medium from escaping. The piston rod is guided in a sleeve mounted in the enclosure so as to be axially movable, with a flange being arranged at the rear end of it.

Objective of the invention is to provide an applicator of the kind first mentioned above which offers excellent tightness properties and is of unsophisticated design suitable to dispense its flowable application medium, in particular nail polish, in a properly dosed manner.

According to the invention this objective is reached by the features of claim 1, i.e. by providing a piston rod designed with a flange in a central section and by providing a sealing element that enables the piston rod to be sealed off along its circumference.

In this way, the spring element can be located inside the application medium containing reservoir between the flange and an inner abutting face of the tip portion. It is also possible to arrange the spring element outside the reservoir so that it is not in contact with the application medium contained in the reservoir. A design configuration of the latter kind offers the advantage that inadvertent chemical reactions between the application medium and the spring element are avoided which has a positive effect not only on the properties of the application medium on a long-term basis but also on the long-term characteristics of the inventive applicator.

As a result of the sealing element sealing off the piston rod inside the reservoir the internal tightness of the applicator is reliably achieved so that the consistency of the flowable application medium located in the reservoir remains unimpaired even when the applicator has not been in use for a longer period of time.

It has proved especially advantageous if the flange provided on the piston rod is designed to have a thrust face on its back facing the actuating device, and if the sealing element is provided with a circumferential seal lip embracing and sealing off the piston rod. Due to the special design configuration of the thrust face the seal lip is capable of exerting high pressure on the piston rod.

The thrust face in this case is preferably profiled in such a way that when the applicator is not in use it forces the seal lip of the sealing element reliably and circumferentially sealing against the piston rod aided by the spring element provided on the piston rod.

According to the invention the sealing element may be designed to have a cylindrical sleeve portion with tapered front-end portion provided with a circumferential movable seal lip. The cylindrical sleeve portion of the sealing element may be connected in this case with the forward portion of the actuating device in a form-closed manner, i.e. is provided, for example, with a securing bead or securing knobs on the inside which engages/engage in a groove arranged in a forward portion of the actuating device or rearward closure element of the reservoir.

The sealing element may be composed of an independently made component mounted at the actuating device or rearward closure element of the reservoir. Another design possibility in this context is to arrange for the sealing element to be connected to the actuating device or closure element of the reservoir in a firmly bonded manner, for example by attaching it by means of a two-component plastic molding method.

In a high-grade embodiment of the inventive applicator the actuating device may be designed in the manner of a ballpoint-pen pushing mechanism. In this case the actuating device designed in the manner of a ballpoint-pen pushing mechanism may be operated by means of a push button pertaining to a ballpoint-pen pushing mechanism or preferably by means of the closure cap which can be removed from the tip portion of the applicator.

In a more simple design of the applicator according to the invention the closure cap removable from the tip portion of the applicator can be provided so as to serve as push button for the forthwith, direct actuation of the piston rod. For this purpose a head part may be arranged at the rearward end of the piston rod. This design variant of the applicator makes it necessary to keep the push button pressed against the force of the spring element while the flowable application medium is spread on.

It has proved advantageous to temporarily attach the closure cap captively to the rearward end of the piston rod so that the applicator according to the invention can also be held without difficulty with its application end in upward position thus ensuring the closure cap is prevented from detaching from the applicator inadvertently.

It is thought to be of special advantage if the closure cap sealing off in its closed state the tip portion abuts in a sealing manner with a resilient sealing element provided inside on its bottom on a planar or conical annular face of the tip portion so that when the applicator is not in use and closed off by means of the closure cap a reliable sealing effect is achieved not only on the rear side through the above described sealing element but also on the front side, with the volume in the tip portion defined by its central passage hole being very small. This has a beneficial effect on the flowable application medium because its consistency will not be affected, i.e. impaired, in such a small space.

According to the invention the reservoir in the applicator of the kind first mentioned above may as well be directly sealed off tightly on the rear side and the actuating device intended to operate the piston rod in the form of a push button is coupled to the piston rod magnetically through the wall of the reservoir. Such a magnetic coupling function may for example be realized in that the piston rod is provided with at least one permanent magnet element at its rearward end portion and the push button of the actuating device is provided with at least one magnetizable element which may be a metal ring, for example. Moreover, an optional variation involves the piston rod being provided at its rearward end portion with at least one magnetizable element and the actuating device comprising at least one permanent magnet element. When the actuating device in the form of the push button is operated, i.e. axially moved, the piston rod is likewise moved axially as a result of the magnetic coupling function acting through the wall of the reservoir. The wall of the reservoir in this case consists of a material permeable to a magnetic field.

For the applicator according to the invention the application element is preferably a brush element. Such a brush element enables nail polish to be optimally applied. The application element may also consist of a capillary wick or sinter material or the like suitable to appropriately apply a desired application medium.

According to the invention the flowable application medium is preferably transported via design configuration characteristics offering particularly good flow conditions, wherein existing sealing gaps may be larger in a favorable manner so as to facilitate air balancing and prevent sticking or incrustation provided the system is correctly put to use.

Dosing of the application medium is preferably achieved via two spaces situated in the tip portion of the applicator which are separated, at least temporarily, by a dosing element arranged on the piston rod or by a dosing portion of the piston rod forming the dosing element, i.e. a feeding space and a dosing space jointly forming the central passage hole of the tip portion.

When the application element is initially moved out of the tip portion a certain amount of the flowable application medium is conveyed from the feeding space into the front-end dosing space by means of the dosing element and dosing portion of the piston rod. When the application element is retracted it becomes covered by the flowable application medium existing in the dosing space.

Extending the application element again causes the flowable application medium to be carried, via the application element, out of the dosing space and the medium can then be applied, i.e. wetting/coating of the application element is primarily achieved when the applicator is actuated for the second time. At the same time flowable application medium is again conveyed from the feeding space into the dosing space. When medium is applied the dosing space and the feeding space are then preferably sealed off to prevent flowable application medium from advancing in an uncontrolled manner.

For this purpose specially formed sealing beads may be arranged on the dosing element or dosing portion of the piston rod and/or in the central passage hole of the tip portion of the applicator, said sealing beads bringing about an essentially static sealing effect in the "application element extended" and "application element retracted" positions.

During the dosing process a certain amount of the flowable application medium is constantly fed in a controlled manner through a suitably formed gap seal arranged between the dosing element, resp. the dosing portion of the piston rod and the feeding space in the tip portion of the applicator.

Depending on the manufacturing method adopted grooves and/or bead configurations may be provided to enable the medium to be transport in flow controlled fashion. For example, by providing the beads or grooves with sawtooth-type cross sections the flow resistance to be overcome by the advancing application medium on the dosing element or dosing portion of the piston rod is correspondingly high whereas while movement in this direction takes place resistance is low on the inner wall of the central passage hole of the tip portion of the applicator. This enables the flowable application medium to be optimally conveyed forward.

When the piston rod with attached dosing element is moved back, i.e. to the rear end inside the reservoir, the flow resistance in the central passage hole is higher than on the dosing element or dosing portion of the piston rod. Accordingly, the flowable application medium remains inside the dosing space and in this way is capable of covering/adhering to the application element. This process can even be made more effective by appropriately designing the surface which influences adhesion and/or capillary forces acting on the flowable application medium. In another inventive embodiment the dosing effect is almost entirely brought about as a result of the adhesion and/or capillary forces produced by appropriately designing the surfaces.

As still another embodiment helical grooves or beads may be provided as they are recommendable for certain manufacturing methods. Round cross sections are preferable in this case. However, to achieve good dosing element guiding properties other cross sections may also be of advantage. For example, a rectangular cross section in a round bore results in four guide edges.

The Inventive Applicator Offers the Following Benefits:

Relatively large gap widths may be provided which results in low frictional forces and enables relevant actuating forces to be kept low. Moreover, considerable independence is gained with respect to handling different viscosities of the liquid application medium to be applied which enables the application range of the inventive applicator to be broadened significantly. Advantageously, a sticking/jamming effect is also avoided in this way and the required exchange of air between the reservoir and the outside facilitated. This is also considered beneficial in that it prevents the formation of bubbles.

Especially in the design wherein two static sealing locations are provided a constantly good dosing effect is achieved and dripping of the medium ruled out.

Due to the omission of complex sealing points for movable elements a considerably simpler design of the applicator with comparatively few components is achieved.

As a result of different spatial cross sections the conveying effect for the flowable application medium can even be enhanced.

The conveying effect can be influenced as well by combining various grooves and/or beads, in particular if the advancing dosing element performs a rotational movement as can be accomplished, for example, with the help of certain ballpoint-pen pushing mechanisms acting on the piston rod.

The following functional description shall provide elucidation of the applicator proposed by the invention.

The applicator is provided with a reservoir accommodating the appropriately metered out application medium to be applied. Situated at the outlet opening of the reservoir is a feeding space to which front side a dosing space is arranged. When the applicator is stored the application element is located inside the dosing space which serves the purpose of receiving additional amounts of the application medium. In this space the application element is thus covered with the application medium. The division into two spaces as provided by the invention offers advantages in certain functional positions of the applicator particularly for the design variant with static sealing systems.

In a first actuating step the application element is moved forward out of the discharge opening. By means of the dosing element, respectively dosing portion of the piston rod application medium is then transferred from the reservoir into the dosing space. This takes place by the movement and appropriate shaping of this component and/or by an expediently designed surface. During movement of the dosing element different flow resistance characteristics are taken advantage of when conveying the medium to the application element. This conveying process can be enhanced by providing surfaces having different capillary and/or adhesion effects acting on the fluid application medium.

Moving the dosing element back causes overpressure at least temporarily inside the reservoir which helps application medium to be transported towards the tip but also prevents excessive amounts of application medium from flowing back into the reservoir. A return movement of the dosing elements results in the feed zone of the dosing element, resp. dosing portion of the piston rod to be relocated into the feeding space where it is again covered with a certain amount of application medium.

Due to the inventive design only a minor partial amount of the application medium is returned when retracting the piston rod with dosing element and its dosing portion. Gravitational force and capillary effect of the application element preferably provided in the form of a brush and, as the case may be, additional means in the dosing space prevent medium from being conveyed to the rear, with the exchange of air being promoted simultaneously.

The discharge opening can be sealed off both in application condition with the application element being extended and in inoperative position. When medium is conveyed only limited tightness exists through the gap of the rear conveying portion of the piston rod to the outer face of the feeding space which on the other hand is desirable and gives the system a certain degree of "elasticity". For example, so-called "spitting" can be ruled out in this way.

The transportation of the application medium is primarily effected by way of an appropriate design of the applicator components and its surface.

For certain flowable application media it will be sufficient when the surface is appropriately rough. Structures such as grooves or patterns may also be provided to bring about the transportation effect.

Further details, features and advantages can be seen from the following description of the embodiments of the inventive applicator as illustrated in the figures, and it shall be clearly understood in this context that the invention is by no means restricted to the embodiments shown but shall be determined and governed by the claims listed hereinafter.

Elucidation of the invention is provided by the following figures where

Figure 2:
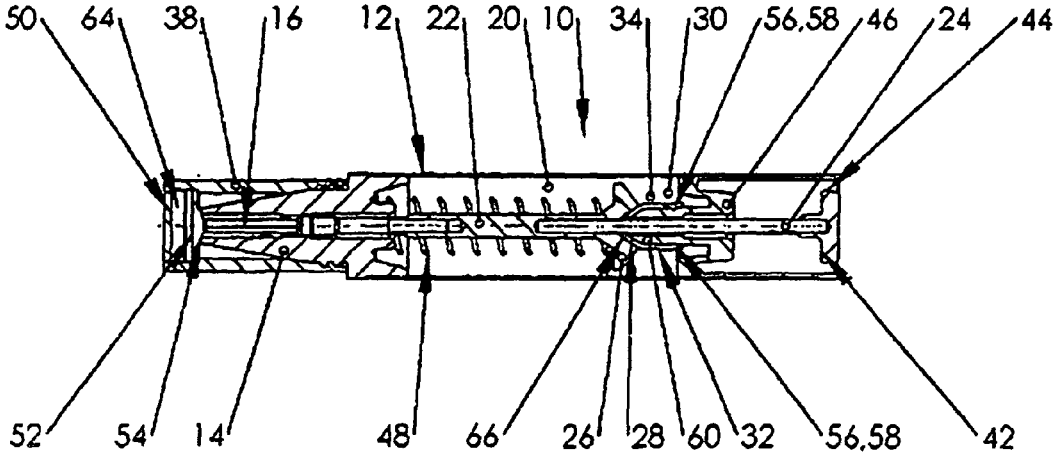
Figure 3:
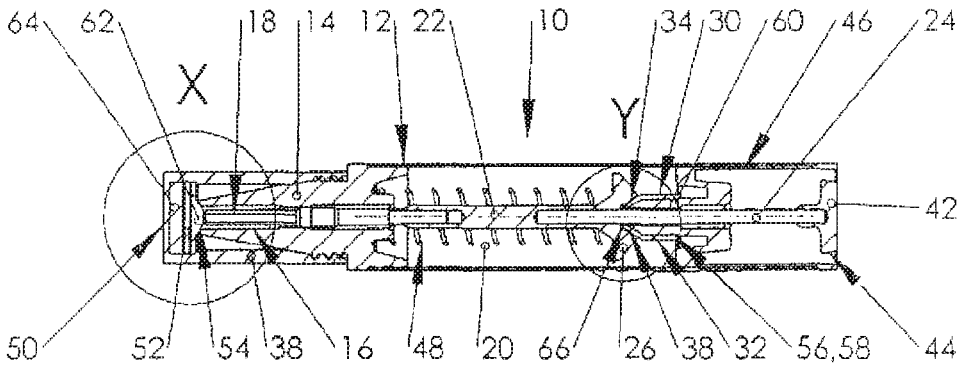
Figure 4:
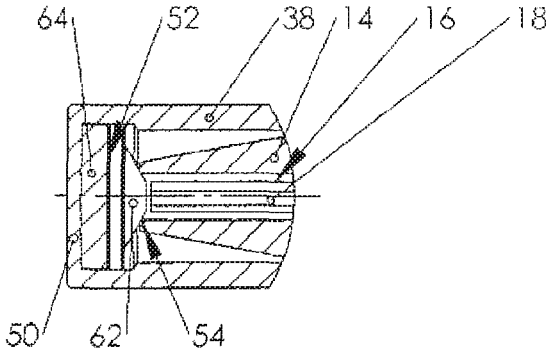
Figure 5:
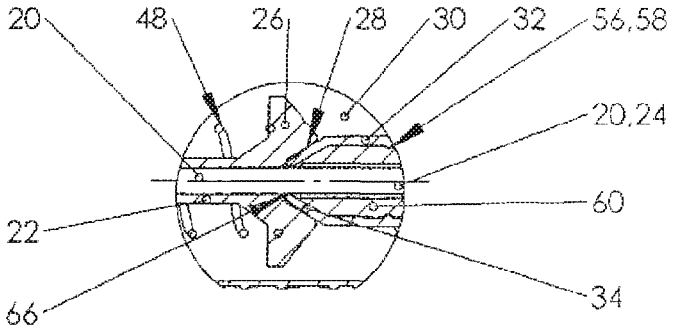
Figure 6:
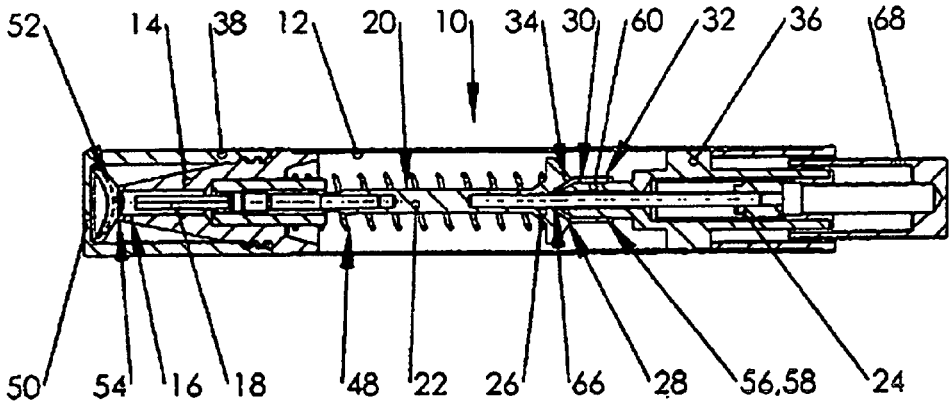
Figure 7:
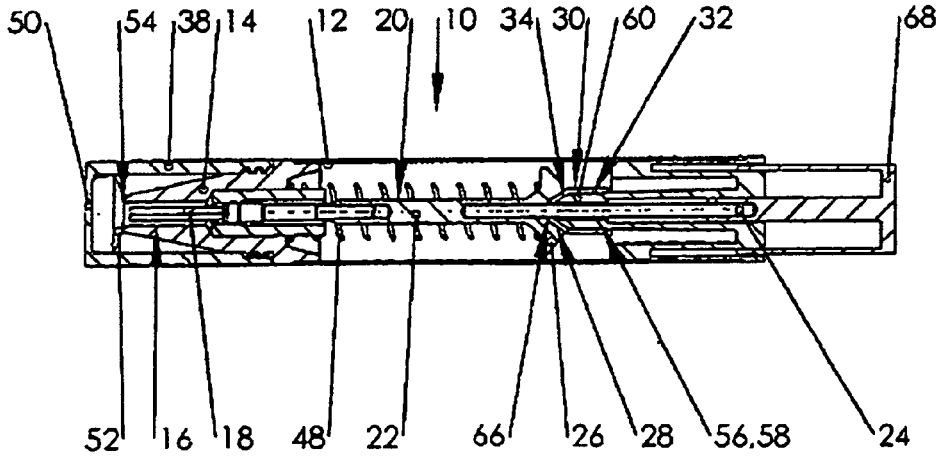
Figure 8:
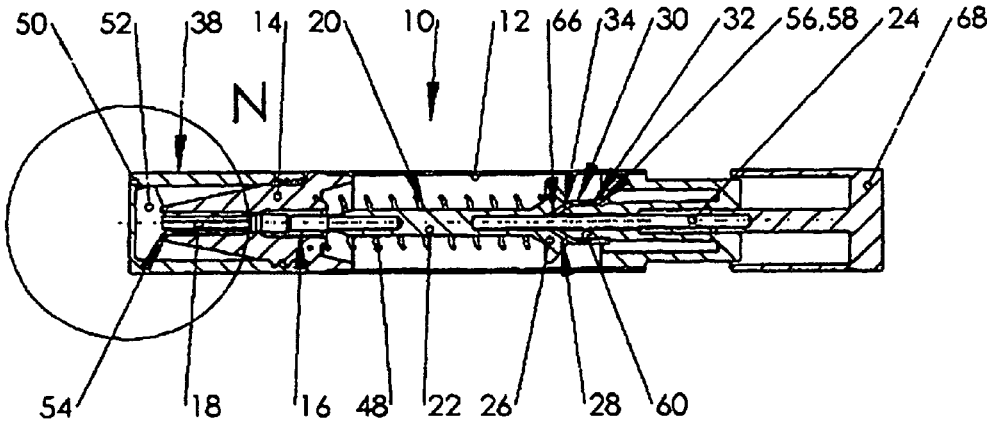
Figure 9:
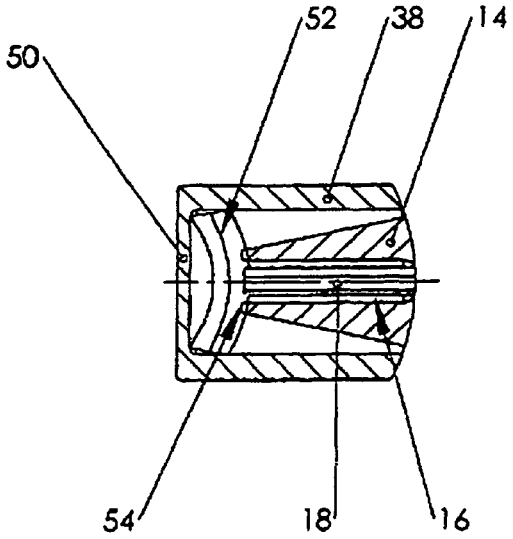
Figure 10:
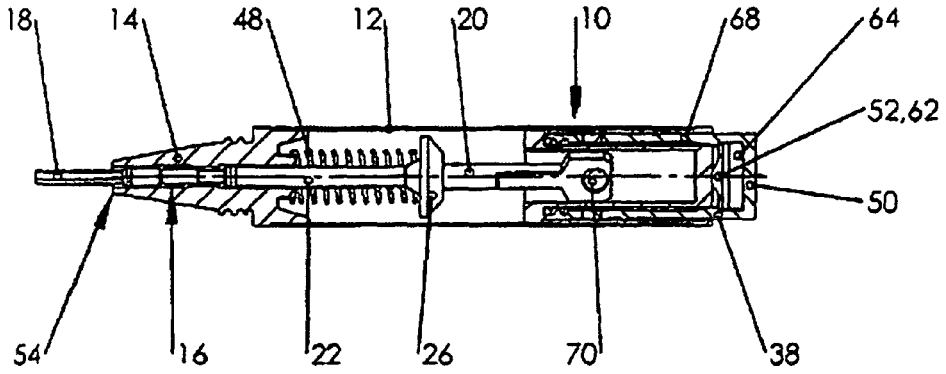
Figure 11:
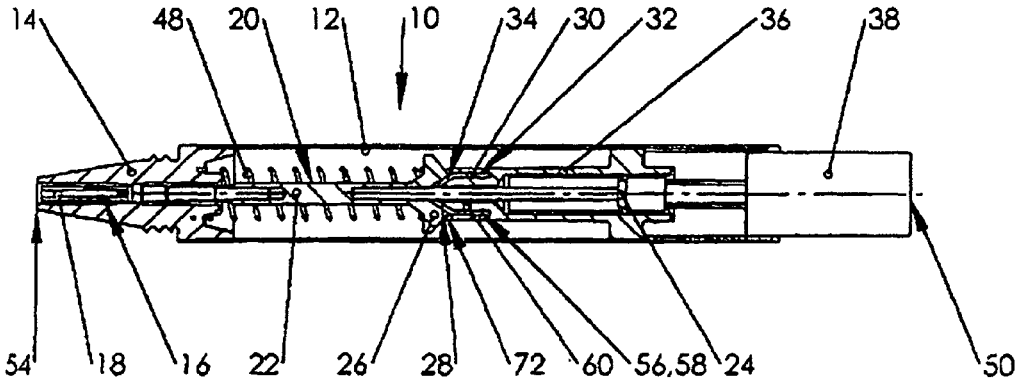
Figure 12:
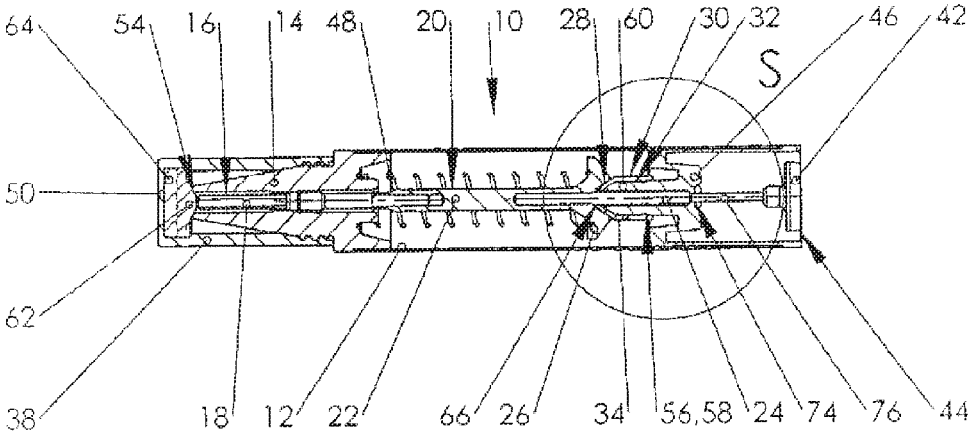
Figure 13:
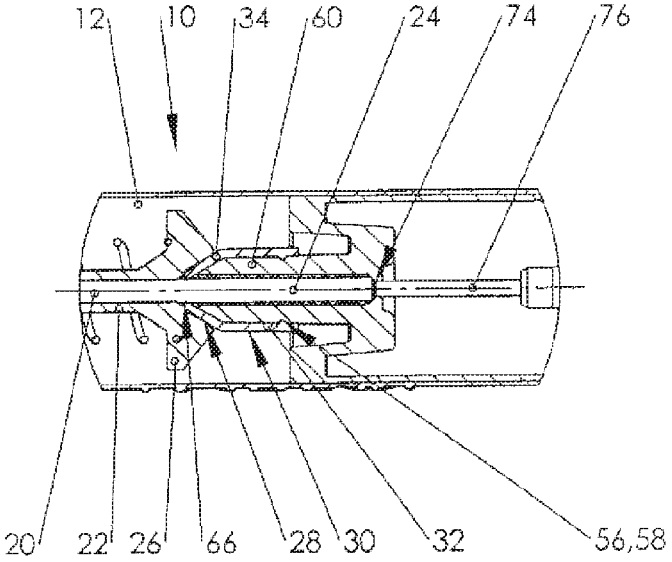
Figure 14:
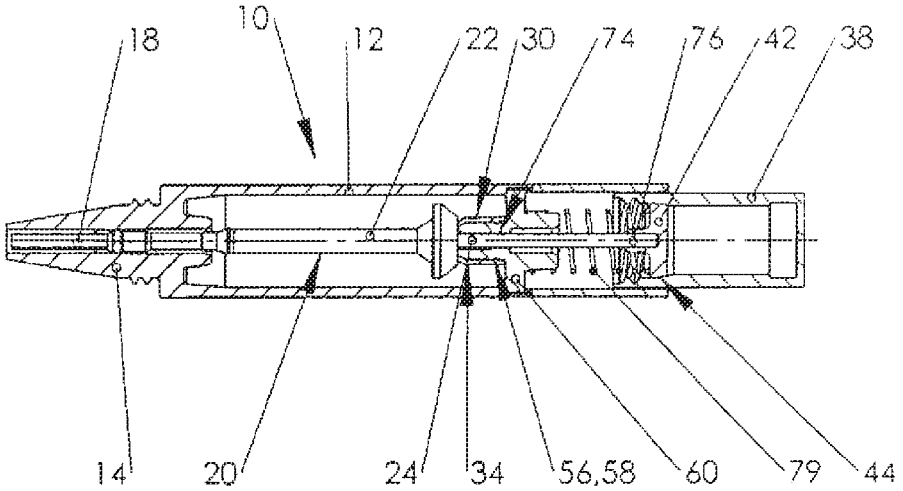
Figure 15:
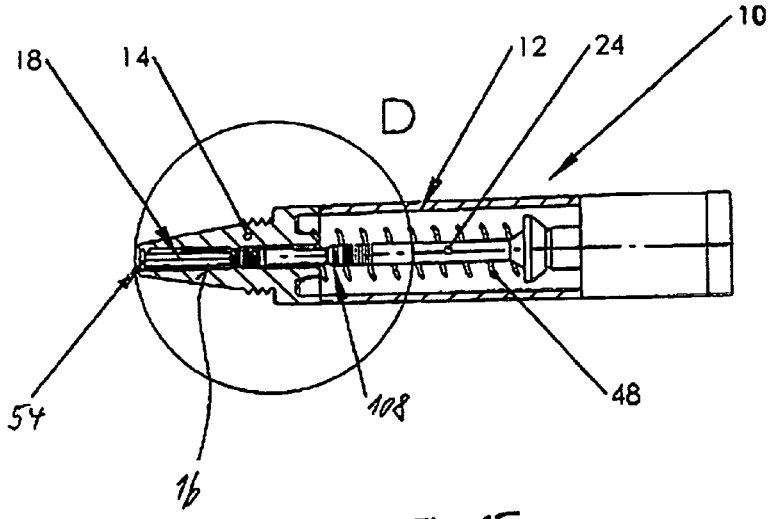
Figure 16:
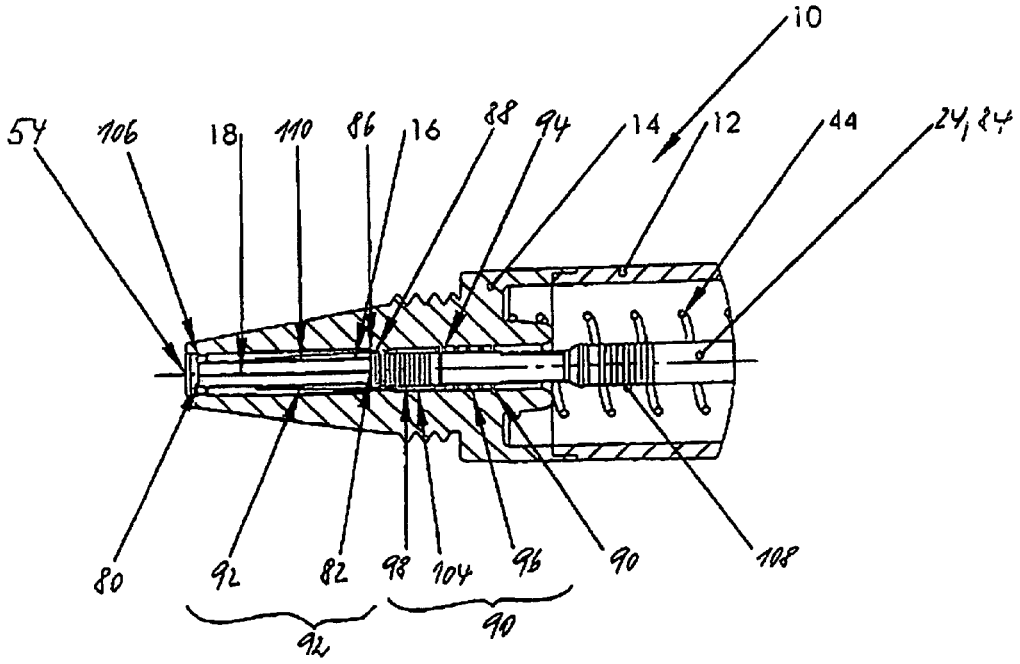
Figure 17:
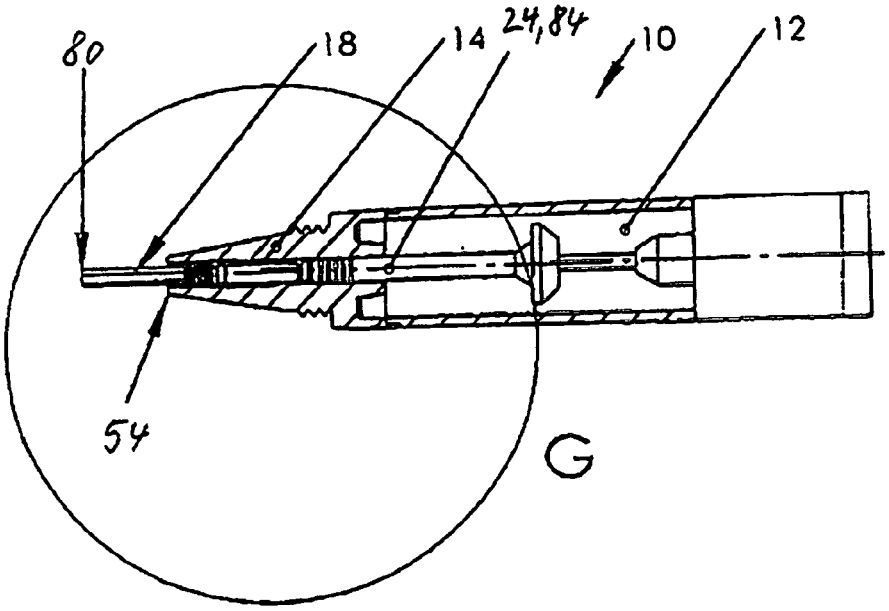
Figure 18:
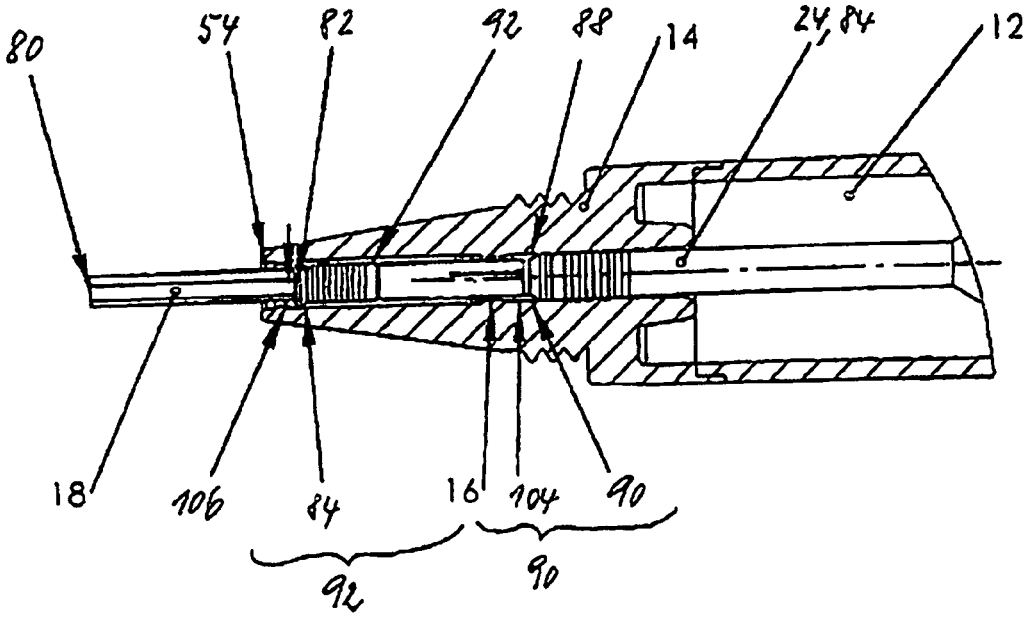
Figure 19:
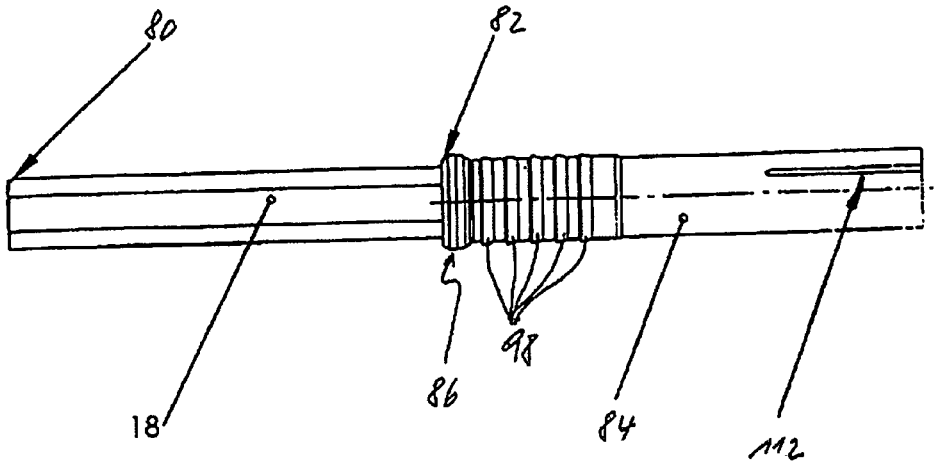
Figure 20:
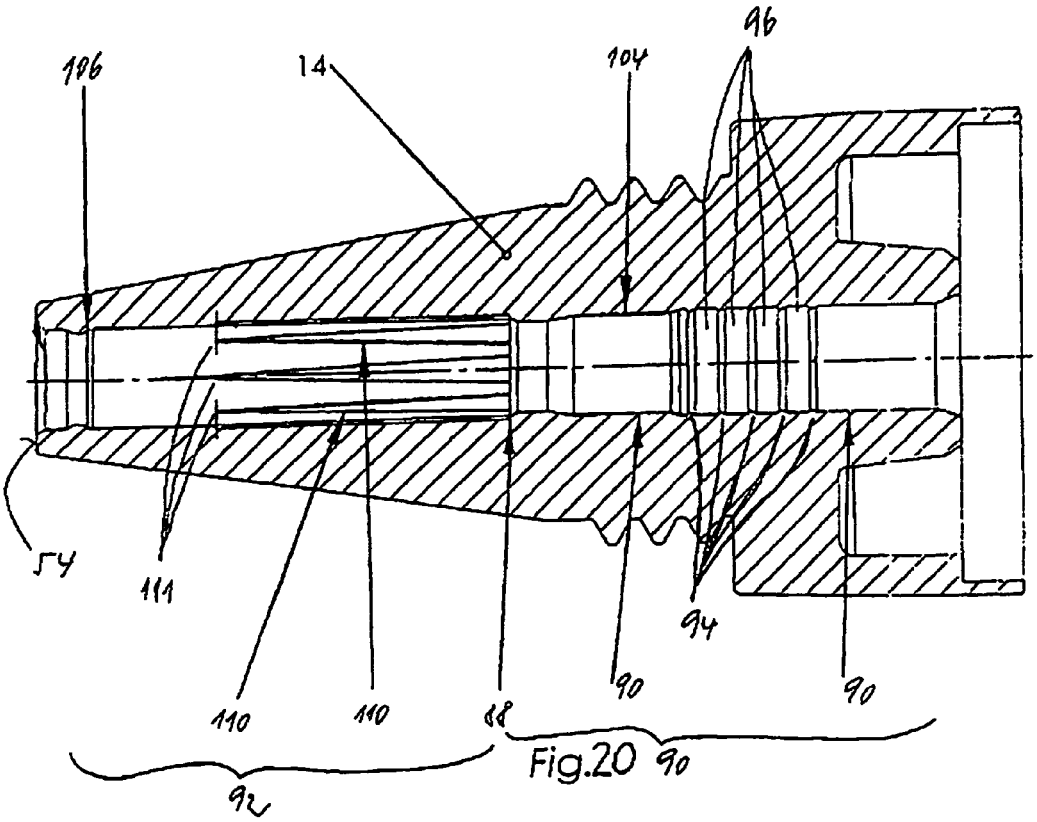
Figure 21:
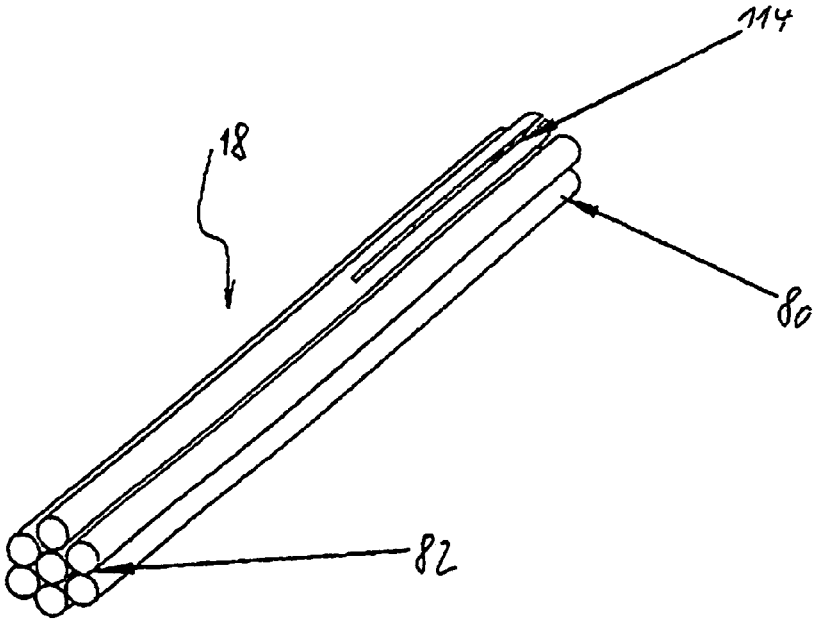
Figure 22:
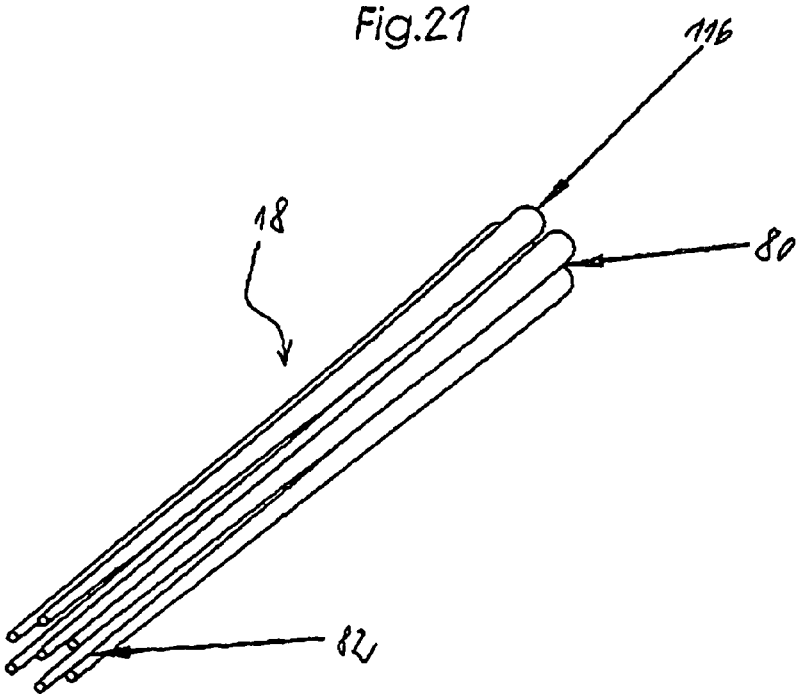

FIG. 1 is a longitudinal section through a first embodiment of the applicator having an actuating device designed in the manner of a ballpoint-pen pushing mechanism, FIG. 2 is a longitudinal section through a second embodiment of the applicator—without ballpoint-pen pushing mechanism—wherein the closure cap detached from the tip portion serves as actuating device for the piston rod, FIG. 3 shows the applicator as per FIG. 2 with a view to illustrating its sealing locations as per detail "X" and detail "Y", FIG. 4 shows detail "X" as a larger scale representation, FIG. 5 shows detail "Y" as a larger scale representation, FIG. 6 shows another embodiment of the applicator as a longitudinal-section representation—with an actuating device for the piston rod in the form of a ballpoint-pen pushing mechanism and a closure cap as well as a push button of the ballpoint-pen pushing mechanism, FIG. 7 is an embodiment of the applicator similar to the one shown in FIG. 6—without ballpoint-pen pushing mechanism, FIG. 8 is a longitudinal section of an embodiment of the applicator with an internally guided push button for the piston rod, FIG. 9 shows on a larger scale detail "N" as per FIG. 8, FIG. 10 illustrates still another embodiment of the applicator as a longitudinally cut representation, wherein the applicator is provided with a magnetic coupling between the piston rod and an actuating device in the form of a push button, FIG. 11 is a longitudinal section of another embodiment of the applicator with additional sealing in the area of the sealing element for the piston rod, and the pertinent flange of the piston rod, FIG. 12 is a longitudinal section of an embodiment of the applicator similar to that shown in FIG. 2, with additional sealing of a split piston rod, FIG. 13 is a larger scale view of detail "S" as per FIG. 12, and FIG. 14 is a longitudinal section through still another embodiment of the applicator, wherein the spring element is not arranged inside the reservoir for the application medium but outside of it so as to avoid chemical reactions between the application medium and the metal of the spring element, FIG. 15 is a longitudinal section view of a first embodiment of the inventive applicator with the application element in "retracted" position, FIG. 16 shows detail D as per FIG. 15 on a larger scale, FIG. 17 is a longitudinal section view of the applicator as per FIG. 15 in activated state with the application element in extended position, FIG. 18 shows detail G as per FIG. 17 on a larger scale, FIG. 19 illustrates an embodiment of a dosing element to be connected with the piston rod with an application element, FIG. 20 shows the tip portion of the applicator as a longitudinal section view with a conceivable configuration of the central passage hole, FIG. 21 shows an embodiment of the application element with capillary effect towards the application side, and FIG. 22 shows another embodiment of the application element for the transfer of the application medium to an application site.

FIG. 1 in the form of a longitudinal section view shows an embodiment of applicator 10 intended for a flowable application medium, in particular nail polish. Applicator 10 is provided with a reservoir 12 accommodating the flowable application medium. At the front end of reservoir 12 a tip portion 14 is arranged that has a central passage hole 16. Passage hole 16 is intended for an application element 18, preferably provided in the form of a brush element. The application element 18 is attached to a piston rod 20. Piston rod 20 comprises piston rod portion 22 at the front end and attached to it a rear-end piston rod portion 24. Expediently, the front-end piston rod portion 22 consists of suitable plastic material and the rear-end piston rod portion 24 advantageously of an appropriate metal. Optionally, the piston rod 20 may of course be of one-piece design consisting of suitable material.

The front-end piston rod portion 22 is provided at its inner end with a circumferential flange 26 which has a thrust face 28 on its rear side.

A sealing element 30 is always, that is both during activated application state with application element 18 projecting out of the tip portion 14 and when in rest resp. storage position, as it is for example illustrated in FIG. 2, circumferentially arranged at the rearward piston rod portion 24 of piston rod 20 to achieve a reliable sealing effect at the rear end.

In the embodiment shown in FIG. 1 the sealing element 30 has a cylindrical sleeve portion 32 and a tapered front-end portion 34 and is arranged at an actuating device 36 which is designed in a manner resembling a ballpoint-pen pushing mechanism the design and functioning of which need not be discussed here in more detail because it does not form part of the present invention.

Actuating device 36 serves to adjust the application element 18 by moving it out of the tip portion 14 and into a discharging, i.e. application position for the flowable application medium contained in reservoir 12, temporarily hold the application element 18 in said discharging position, and move the application element back into the tip portion 14.

The actuating device 36 of the embodiment of the applicator 10 according to FIG. 1 is provided in the form of a closure cap 38 which is removed, for example unscrewed, from the tip portion 14 and temporarily mounted on the rear end of the applicator 10 to enable the actuating device 36 to be manipulated by exerting pressure on closure cap 38. It is thought beneficial here if actuating device 36 and closure cap 38 can be temporarily and captively connected with each other within the self-retaining annular area 40. Said self-retaining annular area is defined on the one hand by a head part 42 allocated to the actuating device 36 and otherwise by a tapered annular face 44 formed inside the closure cap 38.

FIG. 2 shows an embodiment of applicator 10 in the closed non-used state, wherein the rearward piston rod portion 24 is provided at its rear end directly and uninterruptedly—i.e. without actuating device in the manner of a ballpoint-pen pushing mechanism—with a head part 42 designed so as to comprise a tapered annular face 44. In this embodiment the rearward piston rod portion 24 of the piston rod 20 extends through a closure element 46 located in the rear of reservoir 12. Sealing element 30 is arranged at the rearward closure element 46.

Between flange 26 arranged at the forward piston rod portion 22 and the rear, i.e. inner side of tip portion 14 a spring element 48 designed as helical compression spring is mounted so as to embrace the piston rod.

Inside closure cap 38 and near its end 50 a resilient sealing element 52 is arranged which abuts with sealing effect on an annular face 54 of the tip portion 14 when the applicator 10 is not in use, i.e. has been closed. As a result of the forward sealing element 52 and the inner, resp. rearward sealing element 30 an optimal sealing system of applicator 10 is thus achieved—irrespective of any special design of the applicator.

In sealing element 30 the cylindrical sleeve portion 32 is provided with a securing bead 56 on the inside which engages with a circumferential channel 58 formed out in a forward portion 60 of the actuating device 36 (see FIG. 1) or in the rearward closure element 46 (see FIG. 2).

Optionally, the sealing element 30 may be designed so as to be firmly bonded to the actuating device 36 or the rearward closure element 46. This may be achieved by adhesive bonding, two-component molding or similar methods.

FIGS. 3 and 4 illustrate particulars similar to those included in FIGS. 1 and 2 so that the information provided by way of FIGS. 1 to 2 need not be described/recapitulated here in every detail again. In this case, FIG. 4 is an enlarged representation of the sealing element 52 provided with a dimensionally stable sealing component with a sealing cone portion 62 and elastic cushioning part 64. The sealing element 52 abuts with its sealing cone portion 62 on annular face 54 of the tip portion 14 and thus performs its sealing function when applicator 10 has been locked by means of closure cap 38.

FIG. 5 provides information on the rearward sealing element 30 and in particular its tapered front-end portion 34 which closely and in a sealing manner abuts with circumferential seal lip 66 on the piston rod 20, resp. its rearward piston rod portion 24.

FIG. 6 is a longitudinally cut view of an embodiment of applicator 10 provided with an actuating device 36 designed in the manner of a ballpoint-pen pushing mechanism similar to that shown in FIG. 1 for the applicator 10. Applicator 10 has both a closure cap 38 and also a push button 68 which forms a constructional part of the ballpoint-pen pushing mechanism. Moreover, a sealing element 52 has been shown schematically which is formed by a resilient arched surface element which abuts in a sealing manner on the annular face of the tip portion 14 when the closure element has been locked.

FIG. 7 is a longitudinally cut view of an embodiment of applicator 10 which differs from the embodiment illustrated in FIG. 6 in that it has not been provided with an actuating device 36 designed in the manner of a ballpoint-pen pushing mechanism but instead has a push button 68 connected directly and uninterruptedly with the piston rod 20, i.e. its rearward piston rod portion 24.

FIG. 8 is a longitudinally cut view of an embodiment of applicator 10, wherein the piston rod 20, resp. its rearward piston rod portion 24 is directly and uninterruptedly connected with a push button 68, and wherein—as is especially evident from FIG. 9—the forward sealing element 52 is designed in the form of an elastic cap element which may for example be provided with a metal insert or a metal lining so as to form a diffusion barrier for the flowable application medium, in particular nail polish, contained in the reservoir 12 of applicator 10. While in the embodiment according to FIG. 6 the push button 68 is externally guided, it is internally guided as per the embodiment shown in FIG. 8.

FIG. 10 is a longitudinally cut view of an embodiment of applicator 10, wherein the reservoir 12 is closed off at the rear in such a manner that piston rod 20 in this case does not project on the rear end from reservoir 12 to enable an operative connection to be brought about with a push button 68; instead piston rod 20 and the actuating device intended to act on the piston rod 20 in the form of a push button 68 are magnetically coupled across the wall of reservoir 12 in this embodiment. For this purpose the piston rod 20 is provided with a magnetic element 70 located at its rearward piston rod portion 24 and the push button has a magnetizable element such as a magnetizable metal ring that can be magnetized across the wall of reservoir 12. In this case the wall of the reservoir 12 consists of a material permeable to a magnetic field.

FIG. 11 is a longitudinally cut view of an embodiment of applicator 10, wherein the inner rearward sealing element 30 arranged on an actuating device 36 in the manner of a ballpoint-pen pushing mechanism is provided with an additional outer seal 72 to avoid even more reliably any undesirable diffusion phenomena that might occur through the elastic material of sealing element 30 when the applicator 10 has been stored for a prolonged period of time.

FIGS. 12 and 13 depict an embodiment of applicator 10 essentially similar to the one shown in FIG. 2 provided with an additional seal 74 arranged between a shortened rearward piston rod portion 24 and a rear end extension portion 76 of piston rod 20.

FIG. 14 illustrates an embodiment of applicator 10 which differs from the embodiment shown for example in FIG. 2 particularly in that the spring element 79 is not arranged inside the reservoir accommodating the application medium so that the application medium will not at any time be in contact with the spring element 79. In this way, undesired reactions between the application medium and the metal of the spring element are avoided. This will have a positive effect on the properties of the application medium in the long run and thus on the long-term characteristics of the applicator.

FIGS. 15 to 18 show an embodiment of applicator 10 for a flowable application medium, especially nail polish, with a reservoir 12 accommodating the application medium. At the front end of reservoir 12 a tip portion 14 is arranged that has a central passage hole 16 for an application element 18. The application element 18 is attached to a piston rod 20. The piston rod 20 is connected to a dosing element 84 or formed so as to include such an element.

The application element 18 is designed so as to have an application end 80 and a fastening end 82 via which the application element 18 is attached to the dosing element 84 (refer to FIG. 16). Dosing element 84 faces the fastening end 82 of application element 18 and is provided with a static sealing bead 86 acting on the annular inner ring sealing face 88 formed in the central passage hole 16 of the tip portion 14. The central passage hole 16 has been provided with a feeding space 90 and on its front end an adjacent dosing space 92 with the annular inner ring sealing face 88 arranged in between.

Dosing element 84 has a surface contour at least relative to the feeding space 90 that results in increased flow resistance with respect to the surrounding application medium. Optionally, the surface of the dosing element 84 can be designed such that the flow resistance is greater when the medium flows in forward direction and lower when it flows in opposite direction, i.e. towards the rear.

Reference numeral 94 denotes beads formed in the feeding space 90 between which grooves 96 are arranged separating said beads (refer to FIG. 20). Reference numeral 104 identifies a sealing stage located in the tip portion 14. Marked by reference numeral 106 is a surface change, which may for example be configured in the form of a scraper bead, said bead being situated at the front end of the dosing space 92 of tip portion 14 and interacting with the application element 18 to remove in a defined manner surplus application medium from the application element 18.

FIG. 15 moreover shows a surface change which may be configured, for example, in the form of an inner feeding bead 108 provided on the piston rod 20 adjacent to the dosing element 84.

Dosing space 92 of the central passage hole 16 of tip portion 14 is provided with slot deepenings 110 (see FIG. 20) extending from the annular inner ring sealing face 88, tapering in forward direction and terminating in tips 111.

At its rear inside end portion the dosing element 84 is provided with at least one slot 112 to enable the dosing element 84 to be easily, reliably, and firmly connected to the piston rod 20 (refer to FIG. 19).

In FIG. 21 an embodiment of the application element 18 is shown, wherein with a view to increasing the surface towards the application end 80 a division of fibers or brush 114 has been provided. FIG. 22 on the other hand depicts an embodiment of the application element 18, wherein with a view to increasing their surface the fibers or brush hairs have a cross section towards the application end 80 which is larger than that at the fastening end 82 of the application element 18.

The application element 18 may be of any conceivable configuration and/or shape. Optional cross sectional shapes may be provided but of significance is the application element 18 is designed in such a manner that the application medium adheres excellently at least to the surface of said element. The application element may, for example, comprise brush hairs, fibers, fabrics or the like, the adhesion capacity and/or capillary attraction of which enable the application medium to remain inside the dosing space 92, a requirement the dosing element 84 expediently designed in terms of fluid flow can help to achieve.

Particulars which are similar in all figures are in each case identified by the same reference numerals so that the information provided by way of the figures need not be repeatedly described/recapitulated in every detail.

LIST OF REFERENCE NUMERALS

10 Applicator
12 Reservoir (of 10)
14 Tip portion (of 10 at 12)
16 Central passage hole (in 14)
18 Application element (of 10 at 20)
20 Piston rod (of 10)
22 Forward piston rod portion (of 20)
24 Rearward piston rod portion (of 20)
26 Flange (at 22)
28 Thrust face (on 26 for 30)
30 Sealing element (of 10 for 20)
32 Cylindrical sleeve portion (of 30)
34 Tapered front-end portion (of 30)
36 Actuating device (of 10 for 20)
38 Closure cap (of 10)
40 Self-retaining annular area (between 36 and 38)
42 Head part (of 40 on 20)
44 Tapered annular face (in 38 and on 42)
46 Rearward closure element (of 10 for 12)
48 Spring element (of 10 for 20, between 14 and 26)
50 End (of 38)
52 Sealing element (in 38)
54 Annular face (of 14)
56 Securing bead (on 32)
58 Channel (in 60)
60 Forward portion (of 36)
62 Sealing cone portion (of 52)
64 Cushioning part (of 52 for 62)
66 Seal lip (on 34 for 20)
68 Push button (of 10)
70 Permanent magnet element
72 Additional seal
74 Seal
76 Rear end extension (of 20)
79 Spring element (of 10 for 20; between 42 and 46)
80 Application end (of 18)
82 Fastening end (of 18)
84 Dosing element (an 18 in 16)
86 Static outer sealing bead (of 24)
88 Annular inner ring sealing face (on 14)
90 Feeding space (of 16)
92 Dosing space (of 16)
94 Bead (in 14)
96 Groove (in 14)
98 Bead (on 24)
104 Sealing stage (in 14)
106 Surface change/scraper bead (in 14)
108 Surface change/feeding bead (of 84)
110 Slot deepening (in 14)
111 Tip (of 110)
112 Slot (in 84)
114 Fiber division (of 18)
116 Fiber cross section (of 18)

The invention claimed is:

1. Applicator for a flowable application medium comprising a reservoir (12) for accommodating the application medium, said reservoir having front and rear ends, at the front end thereof, a tip portion (14) with centrally arranged passage hole (16) adapted for an application element (18) and, at the rear end thereof, an actuating device having a piston rod (20), with the application element (18) being arranged at the front end of said piston rod and said rod serving to move the application element (18) out of the tip portion (14) and into an application medium discharge position, retain the application element (18) temporarily in the discharge position and retract the application element (18) into the tip portion (14), and a cap (38) for tightly sealing off the tip portion (14) characterized in that the piston rod (20) is designed with a flange (26) in a central section and a sealing element (30) enables the piston rod (20) to be sealed off along the circumference thereof, wherein the applicator has a spring element (79) arranged outside the reservoir (12) accommodating the application medium.

2. Applicator according to claim 1, characterized in that the flange (26) provided on the piston rod (20) is designed to have a thrust face (28) on the back thereof facing the actuating device, and the sealing element (30) is provided with a circumferential seal lip (66) embracing and sealing off the piston rod (20).

3. Applicator according to any one of the claims 1 and 2, characterized in that the sealing element (30) has a cylindrical sleeve portion (32) and a tapered front-end portion (34) provided with a circumferential seal lip (66).

4. Applicator according to claim 3, characterized in that the cylindrical sleeve portion (32) of the sealing element (30) has an inside that is provided with a securing bead (56) which engages with a channel (58) formed out in a position selected from a forward portion (60) of the actuating device (36) or in a rearward closure element (46) of the reservoir (12).

5. Applicator according to claim 4, characterized in that the sealing element (30) is arranged in a position selected from on the actuating device (36) or on the rearward closure element (46) of the reservoir (12).

6. Applicator according to claim 5, characterized in that the sealing element (30) is connected to a component selected from the actuating device (36) or the closure element (46) of the reservoir (12) in a firmly bonded manner.

7. Applicator according to any one of claims 1, 2 and 3 to 6, characterized in that the actuating device (36) a pushing mechanism.

8. Applicator according to claim 7, characterized in that the actuating device (36) can be operated by means of a closure cap (38) which can be removed from the tip portion (14) of applicator (10).

9. Applicator according to claim 8, characterized in that the closure cap (38) removable from the tip portion (14) of the applicator (10) is provided so as to directly actuate the piston rod (20).

10. Applicator according to claim 8 or 9, characterized in that the closure cap (38) can be captively attached temporarily to the rearward end of the piston rod (20).

11. Applicator according to claim 1, characterized in that the closure cap (38) has a closed state sealing off the tip portion (14) and abuts in a sealing manner on an annular face (54) of the tip portion (14) with a resilient sealing element (52) provided on the end (50) thereof.

12. Applicator according to the preamble of claim 1, characterized in that the reservoir (12) is directly sealed off tightly on the rear side and the actuating device intended to operate the piston rod (20) is magnetically coupled to the piston rod (20) through the wall of the reservoir (12).

13. Applicator according to any one of the above claims, characterized in that the application element (18) is provided in the form of a brush element.

14. Applicator according to claim 1, characterized in that a dosing element (84) is arranged on the piston rod (18) that has a surface contour at least in the area of a feeding space (90) of the applicator creating an increased flow resistance with respect to the surrounding application medium, wherein the dosing of the application medium is achieved through the forward movement of the dosing element (84) conveying a certain amount of the application medium into a dosing space (92) provided in a tip portion (14) of the applicator (10), and wherein upon retraction of the dosing element (84) not only pressure balancing takes place but the application medium is also retained in said dosing space (92) by adhesion and/or capillary forces.

15. Applicator according to claim 14, characterized in that the application element (18) is designed in such a manner that the application medium adheres at least to the surface of said element.

16. Applicator according to claim 14, characterized in that the surface of the dosing element (4) is shaped in such a manner that adhesion of the application medium is achieved which in conjunction with gravity is sufficient to transport the application medium towards the dosing space (92), wherein adhesion forces additionally produced in dosing space (92) and the gravitational force acting in the same direction causes at least part of the application medium to remain inside the dosing space thus wetting/adhering to the application element (18).

17. Applicator according to claim 14, characterized in that the diameter in dosing space (92) is at most the diameter of the feeding space (90).

18. Applicator according to claim 14, characterized in that the surface of the dosing element (84) is designed such that the flow resistance is greater when the medium flows in forward direction and lower when it flows in opposite direction towards the rear.

19. Applicator according to claim 14, characterized in that with the dosing element (84) in extended position and connected to the piston rod (20) said rod with application element (18) is designed such that sealing against the storage space of the reservoir (12) of the applicator (10) takes place preventing the flow of medium.

20. Applicator according to claim 14, characterized in that with the applicator (10) in retracted resting position the dosing element (84) also has a sealing effect in a manner that no application medium can advance and exit to the outside via the application tip of the application element (18).

21. Applicator according to claim 14, characterized in that sealing in the activated application state of the applicator (10) is brought about by a cross section slightly smaller than the cross section in feeding space (90) which via a defined movement of the piston rod (20) in extended state produces a reliable sealing effect.

22. Applicator according to claim 21, characterized in that the defined movement of the piston rod (20) is brought about by the function of a reversal mechanism.

23. Applicator according to claim 14, characterized in that the surface in dosing space (92) exerts an increased adhesion and/or capillary effect to retain the application medium in dosing space (92).

24. Applicator according to claim 14, characterized in that additional elements are situated in dosing space (92) which have adhesion and/or capillary effects on the application medium.

25. Applicator according to claim 24, characterized in that the arrangement of the elements in the dosing space (92) is selected from at least one of permanently or detachably or movably.

26. Applicator according to claim 14, characterized in that the application element (18) is designed so as to have a variable adhesion and/or capillary effect intensifying towards the tip.

27. Applicator according to claim 26, characterized in that the variable adhesion and/or capillary effect is produced by fibers and/or brush hairs becoming thinner and/or by fibers and/or brush hairs being divided.

28. Applicator according to claim 14, characterized in that a forward sealing element is designed such that it guides the application element (18) being moved out.

29. Applicator according to claim 14, characterized in that transport of the fluid application medium is enhanced through a structure selected from at least one of spirally grooves in a surface portion of the dosing element (84), spirally grooves on a surface portion of the dosing element (84), embossments in a surface portion of the dosing element (84), embossments on a surface portion, of the dosing element (84), or in the central passage hole (16) of the tip portion (14) of the applicator (10).

30. Applicator according to claim 14, characterized in that different surface areas in the spaces of the applicator are provided with different elements selected from surface structures, designs, or roughness so that conveying effects are exerted not only via capillary forces but also by frictional forces.

* * * * *